US011117245B2

(12) United States Patent
Rodeheaver et al.

(10) Patent No.: US 11,117,245 B2
(45) Date of Patent: Sep. 14, 2021

(54) WRENCH

(71) Applicant: A1 Babbitt Company, Pittsburgh, PA (US)

(72) Inventors: Bradley D. Rodeheaver, Pittsburgh, PA (US); Jackson E. Rodeheaver, Pittsburgh, PA (US)

(73) Assignee: A1 Babbitt Company, Pittsburgh, PA (US)

( * ) Notice: Subject to any disclaimer, the term of this patent is extended or adjusted under 35 U.S.C. 154(b) by 281 days.

(21) Appl. No.: 16/148,718

(22) Filed: Oct. 1, 2018

(65) Prior Publication Data

US 2019/0126444 A1 May 2, 2019

Related U.S. Application Data

(60) Provisional application No. 62/565,200, filed on Sep. 29, 2017.

(51) Int. Cl.
*B25B 13/50* (2006.01)
*B25B 19/00* (2006.01)

(52) U.S. Cl.
CPC ..... *B25B 13/50* (2013.01); *B25B 13/5091* (2013.01); *B25B 19/00* (2013.01)

(58) Field of Classification Search
CPC ..... B25B 13/50; B25B 13/5091; B25B 19/00
See application file for complete search history.

(56) References Cited

U.S. PATENT DOCUMENTS

| | | | | |
|---|---|---|---|---|
| 9,186,780 | B2 * | 11/2015 | Dumaine | B25B 19/00 |
| 9,415,487 | B2 * | 8/2016 | Wilson | B25B 13/08 |
| 10,071,466 | B2 * | 9/2018 | Wilson | B25B 13/04 |
| 10,569,390 | B2 * | 2/2020 | Leys | B25B 13/08 |
| 10,668,601 | B2 * | 6/2020 | Nelsen | B25B 23/12 |
| 2017/0165816 | A1 * | 6/2017 | Wells, Sr. | B25B 19/00 |

* cited by examiner

*Primary Examiner* — David B. Thomas
(74) *Attorney, Agent, or Firm* — The Webb Law Firm

(57) ABSTRACT

A wrench includes a head having a first end and a second end and a handle extending from the head. The head defines and at least partially surrounds an opening. The head further defines at least one recess continuous with the opening. A distance between the first end and the second end of the head is greater than a cross-sectional diameter of a pipe flange of a hammer union.

17 Claims, 3 Drawing Sheets

WRENCH

CROSS REFERENCE TO RELATED APPLICATION

This application claims the benefit of U.S. Provisional Patent Application No. 62/565,200, filed Sep. 29, 2017 and entitled "Wrench", the disclosure of which is hereby incorporated by reference in its entirety.

BACKGROUND OF THE INVENTION

Field of the Invention

The present invention relates to a wrench; more specifically, a wrench for fastening and unfastening hammer unions.

Description of Related Art

Pipe unions are used in various fluid transmission applications to join sections of pipe. Pipe unions are often used at pipe joints where repeated connection and disconnection are expected. Pipe unions allow the joint to be formed without rotating the joined pipe sections relative to one another, and therefore may also be used where a simple coupling cannot be installed. Pipe unions generally include a pair of flanges, each connecting to one of the pipe sections to be joined. Both flanges typically have an external thread such that the pair of flanges, when aligned adjacent to one another, define a continuous threaded surface. After connecting the flanges to the respective pipe sections and aligning the flanges with one another, an internally threaded collar may be threaded onto the continuous threaded surface defined by the flanges. In this manner, a secure joint is created between the pipe sections.

A common application using pipe unions is drilling; for example, oil and gas drilling. During drilling operations, drilling pipe strings are repeatedly joined and unjoined as the drill string is drilled down into a bore hole and subsequently removed. One type of pipe union commonly used in such drilling operations, known as a hammer union, has wings or lugs extending from the collar to facilitate fastening and unfastening. Typically, hammer unions are tightened and loosened by a sledgehammer. The sledgehammer is hit against the wings or lugs of the hammer union in the desired direction to loosen or tighten. One of the problems with using a sledgehammer is the force and pressure exerted on the union with repeated contact. This repeated contact weakens the joints of the hammer union, corrupting the integrity of the pipe connection. Use of a sledgehammer on the hammer union can ultimately lead to cracking, breaking, and failure of the union. The surrounding pipe may also be damaged as a result of using a sledgehammer, which presents a safety hazard especially if the pipes are pressurized.

SUMMARY OF THE INVENTION

In view of the forgoing, there exists a need for safer and more efficient devices and methods for fastening and unfastening hammer unions.

Embodiments of the present invention are directed to a wrench including a head having a first end and a second end and a handle extending from the head. The head defines and at least partially surrounds an opening. The head further defines at least one recess continuous with the opening. A distance between the first end and the second end of the head is greater than a cross-sectional diameter of a pipe flange of a hammer union.

In some embodiments, the head defines a partial recess at the second end of the head.

In some embodiments, the partial recess has the same shape as at least a portion of the at least one recess.

In some embodiments, the first end of the head defines a catch configured to engage a lug of the hammer union.

In some embodiments, the total number of recesses and partial recesses is equal to a number of lugs of the hammer union.

In some embodiments, the at least one recess includes at least two recesses.

In some embodiments, the at least two recesses are spaced apart from one another about a central axis of the head of the wrench such that each of the recesses is configured to align with one lug of the hammer union.

In some embodiments, the at least two recesses are spaced approximately 120° apart from one another about a central axis of the head of the wrench.

In some embodiments, the partial recess is spaced apart from the at least one recess about a central axis of the head of the wrench such that the partial recess and each of the at least one recesses are configured to align with one lug of the hammer union.

In some embodiments, the handle is configured to be rotated by a drilling operator.

Other embodiments of the present invention are directed to a method for fastening or unfastening a hammer union. The method includes providing a hammer union and a wrench. The hammer union has a first pipe flange, a second pipe flange, and a collar having one or more lugs. The collar is configured to be threaded onto the first and second pipe flanges. The wrench includes a head and a handle extending from the head. The head defines and at least partially surrounds an opening, and the head further defines at least one recess continuous with the opening. The method further includes positioning the head of the wrench relative to the hammer union such that a central axis of the head of the wrench aligns with a longitudinal axis of the hammer union. The method further includes sliding the head of the wrench axially toward the collar of the hammer union such that each of the at least one recesses of the wrench align with one of the lugs of the collar of the hammer union. The method further includes rotating the handle of the wrench to rotate the collar of the hammer union relative to the first and second pipe flanges.

In some embodiments, the head of wrench includes a first end and a second end. A distance between the first end and the second end of the head is greater than a cross-sectional diameter of the first and second pipe flanges of a hammer union such that, during positioning the head of the wrench relative to the hammer union, a portion of the first or second pipe flange is passed between the first and second ends of the head of the wrench.

In some embodiments, the first end of the head of the wrench defines a catch configured to engage one of the lugs of the hammer union.

In some embodiments, if the wrench is used for fastening the collar of the hammer union, the wrench is positioned relative to the hammer union such that the catch is at a counterclockwise position relative to the handle.

In some embodiments, if the wrench is used for unfastening the collar of the hammer union, the wrench is positioned relative to the hammer union such that the catch is at a clockwise position relative to the handle.

In some embodiments, the head of the wrench defines a partial recess at the second end of the head, the partial recess configured to align with one of the lugs of the collar of the hammer union.

In some embodiments, the partial recess has the same shape as at least a portion of the at least one recess.

In some embodiments, the at least one recess defined by the head of the wrench includes at least two recesses.

In some embodiments, the at least two recesses are spaced approximately 120° apart from one another about the central axis of the head of the wrench.

In some embodiments, rotating the handle of the wrench is performed by a drilling operator.

These and other features and characteristics of a wrench, as well as methods for fastening, unfastening, tightening, and/or loosening a hammer union with a wrench, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and claims, the singular forms of "a", "an", and "the" include plural referents unless the context clearly dictates otherwise.

BRIEF DESCRIPTION OF THE DRAWING(S)

DETAILED DESCRIPTION OF THE INVENTION

Figure 1:
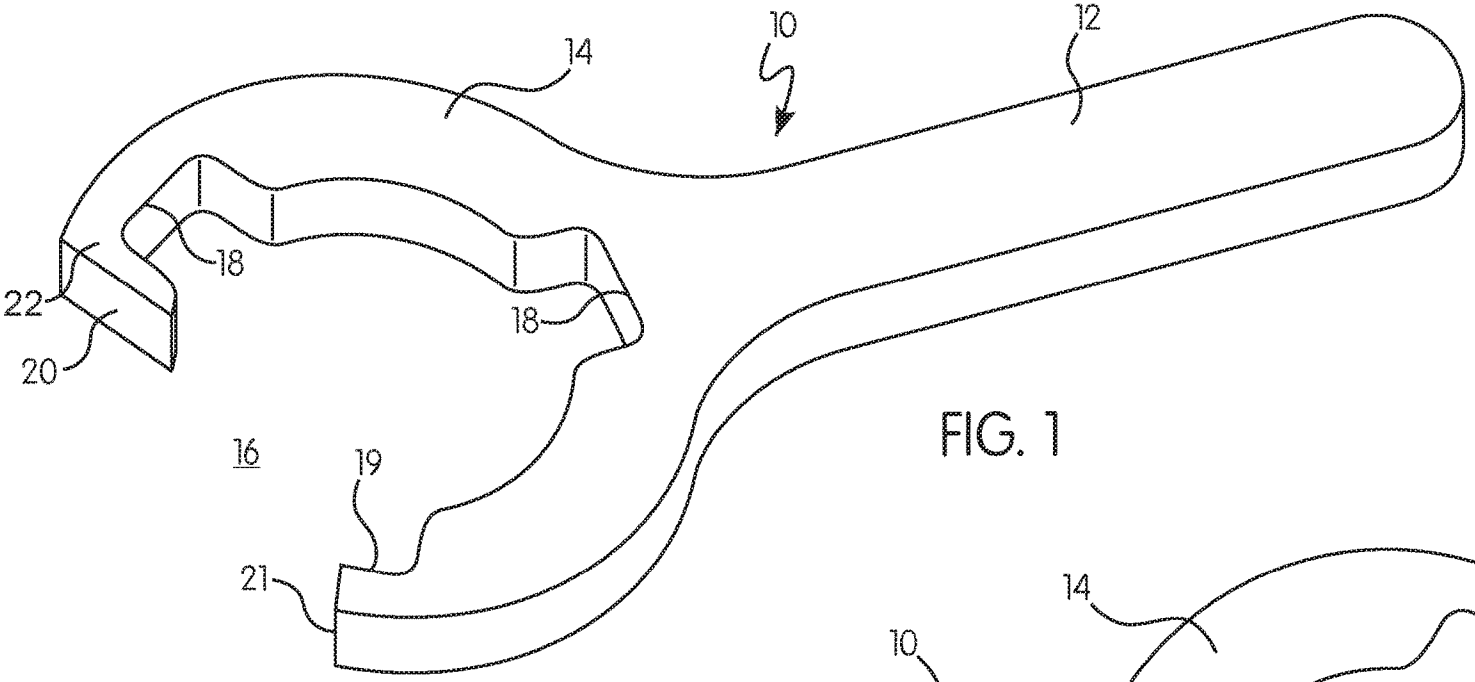
FIG. 1 is a perspective view of a wrench according to an embodiment of the present invention.

For purposes of the description hereinafter, the terms "upper", "lower", "right", "left", "vertical", "horizontal", "top", "bottom", "lateral", "longitudinal", and derivatives thereof shall relate to the disclosed apparatus as it is oriented in the figures. However, it is to be understood that the apparatus of the present invention may assume alternative variations and step sequences, except where expressly specified to the contrary. It is also to be understood that the specific systems and processes illustrated in the attached drawings and described in the following specification are simply exemplary examples of the apparatus disclosed herein. Hence, specific dimensions and other physical characteristics related to the examples disclosed herein are not to be considered as limiting.

As used herein, the terms "substantially" or "approximately", when used to relate a first numerical value or condition to a second numerical value or condition, means that the first numerical value or condition is within 10 units or within 10% of the second numerical value or condition, as the context dictates and unless explicitly indicated to the contrary. For example, the term "substantially parallel to" means within plus or minus 10° of parallel. Similarly, the term "substantially perpendicular to" means within plus or minus 10° of perpendicular. Similarly, the term "substantially equal in volume" means within 10% of being equal in volume.

As used herein, the terms "transverse", "transverse to", and "transversely to" a given direction mean not parallel to that given direction. Thus, the terms "transverse", "transverse to", and "transversely to" a given direction encompass directions perpendicular to, substantially perpendicular to, and otherwise not parallel to the given direction.

As used herein, the term "at least one of" is synonymous with "one or more of". For example, the phrase "at least one of A, B, and C" means any one of A, B, or C, or any combination of any two or more of A, B, or C. For example, "at least one of A, B, and C" includes one or more of A alone; or one or more of B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of". For example, the phrase "at least two of D, E, and F" means any combination of any two or more of D, E, or F. For example, "at least two of D, E, and F" includes one or more of D and one or more of E; or one or more of D and one or more of F; or one or more of E and one or more of F; or one or more of all of D, E, and F.

As used herein, the terms "fastening" and "tightening" are used interchangeably to refer to rotating a first threaded element relative to a second threaded element in order to secure a connection between the first and second threaded elements. Similarly, as used herein, the terms "unfastening" and "loosening" are used interchangeably to refer to rotating a first threaded element relative to a second threaded element in order to disconnect the first and second threaded elements.

Referring to the drawings in which like reference numerals refer to like parts throughout the several views thereof, the present invention is generally directed to a wrench for fastening, unfastening, tightening, and/or loosening a hammer-type pipe union, particularly in gas and oil drilling applications. It is to be understood, however, that the wrench described herein may be used in many different applications in which hammer unions are utilized. The present invention is further directed to methods of fastening, unfastening, tightening, and/or loosening a hammer union.

Figure 2:
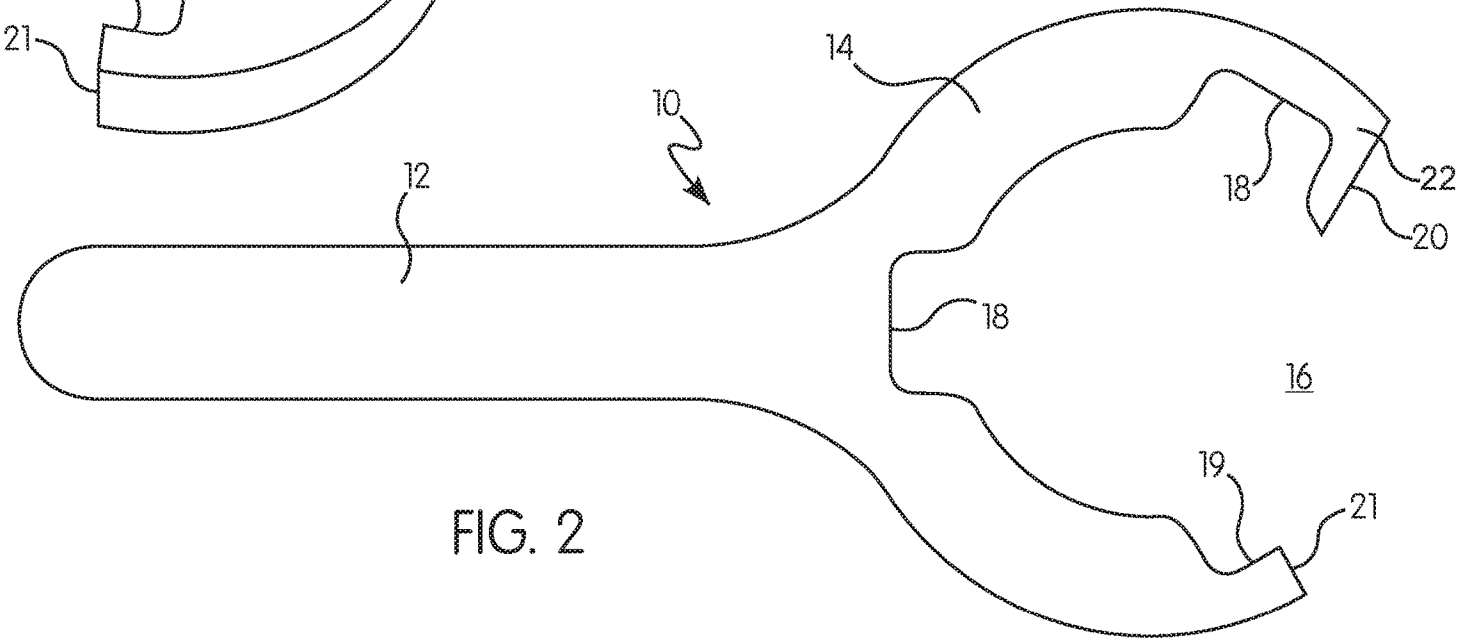
FIG. 2 is a side view of the wrench of FIG. 1.

Referring now to FIGS. 1-2, a wrench 10 according to an embodiment of the invention includes a head 14 and a handle 12 extending therefrom. The head 14, which may be generally round in shape, defines and partially surrounds an opening 16. In particular, a first portion of the head 14 extends from the handle 12 and terminates in a first end 20, while a second portion of the head 14 extends from the handle 12 and terminates in a second end 21. The opening 16 defined by the head 14 may be generally round in shape. The head 14 may further define at least one recess 18 continuous with and/or forming a portion of the opening 16. The at least one recess 18 may be spaced apart from one another at predetermined locations around an inner edge of the head 14. A portion of the head 14 between the first end 20 and the recess 18 nearest the first end 20 may define a finger-shaped catch 22. The head 14 may further define a partial recess 19 in the second end 21 continuous with and/or forming a portion of the opening 16. The partial recess 19 may be generally the same shape as at least a portion of the recesses 18.

Figure 3:
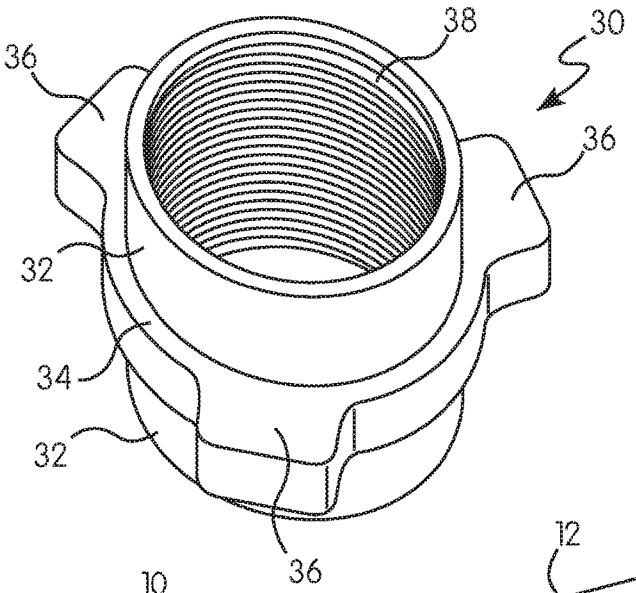
FIG. 3 (Prior Art)
FIG. 3 is a perspective view of a hammer union.

Referring now to FIG. 3, a hammer union 30 as is known in the art generally includes two pipe flanges 32 joined by a collar 34. One or more lugs or wings 36 may be formed on and spaced around the perimeter of the collar 34. The internal surface 38 of the pipe flanges 32 may be threaded, as shown in the drawings, to facilitate connection to externally threaded pipe sections (not shown). In other embodiments, the internal surface 38 of the pipe flanges 32 may be smooth for welding to pipe sections (not shown). As with conventional pipe unions, the pipe flanges 32 may each have an externally threaded portion to facilitate connection with internal threads of the collar 34. The collar 34 may thus be threaded onto both pipe flanges 32 to join the pipe flanges and the pipe section connected thereto.

Figure 4:
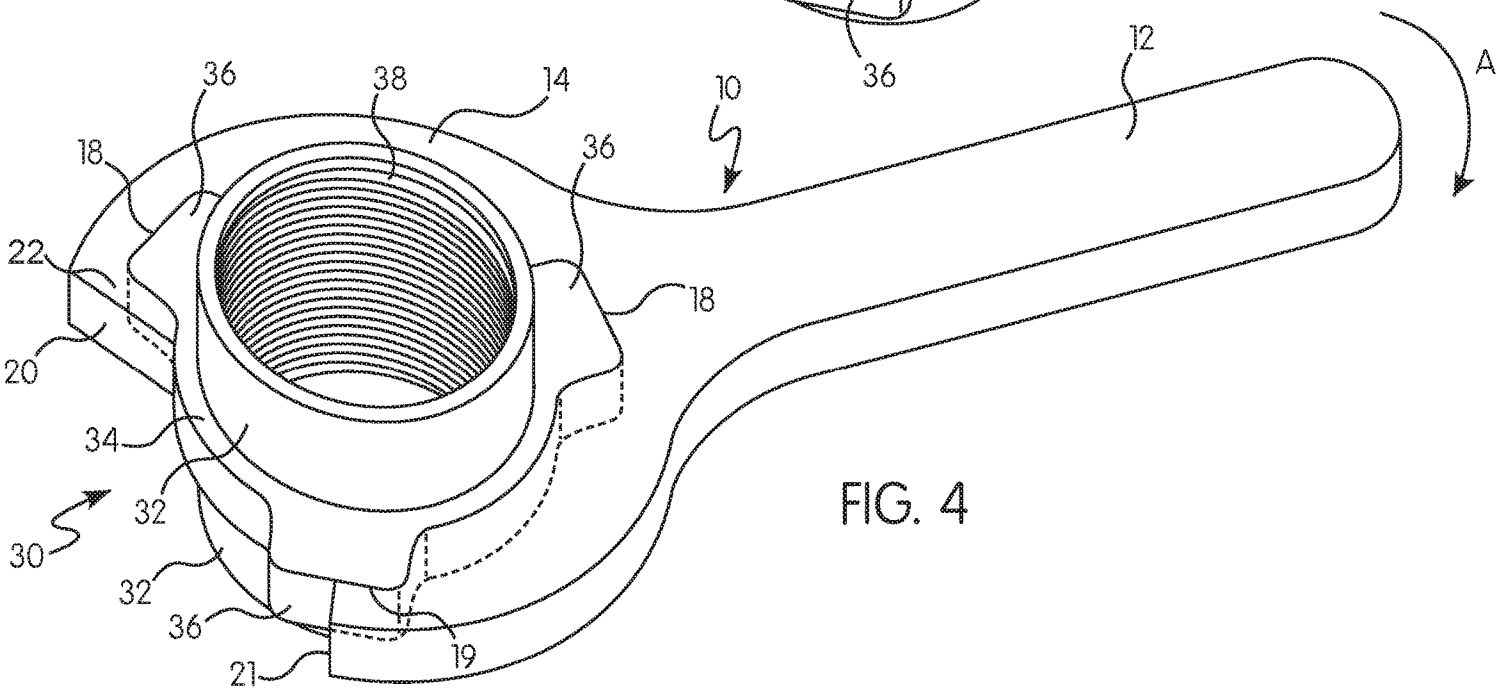
FIG. 4 is a perspective view of the wrench of FIG. 1 positioned on the hammer union of FIG. 3 in a fastening orientation.

Referring now to FIG. 4, the wrench 10 may be configured to fit over the collar 34 of the hammer union 30 to facilitate tightening and loosening of the collar 34. In particular, the opening 16 of the head 14 may be shaped to fit around the collar 34, with the distance between the first end 20 and the second end 21 of the head 14 being greater than a cross-sectional diameter of the pipe flanges 32. As such, the head 14 of the wrench 10 may be slid over one of the pipe flanges 32 from the side, i.e., in a direction perpendicular to a longitudinal axis of the hammer union 30, such that a central axis of the head 14 aligns with the longitudinal axis of the hammer union. The recesses 18 and the partial recess 19 may be sized and arranged to fit over respective lugs 36 of the collar 34 such that the head 14 may be slid over the collar 34 to the position shown in FIG. 4.

In other embodiments, the distance between the first end 20 and the second end 21 of the head 14 may be greater than a cross-sectional diameter of a pipe section connected to one of the pipe flanges 32, such that the head 14 of the wrench 10 may be slid over the pipe section from the side. The recesses 18 and the partial recess 19 may be sized and arranged to fit over respective lugs 36 of the collar 34 such that the head 14 may be slid over the collar 34 to the position shown in FIG. 4.

While the hammer union 30 shown in the drawings includes three (3) lugs 36, any number of lugs 36 may be present on a given hammer union 30. A corresponding number of recesses 18 may be defined in the head 14 of the wrench. More particularly, the head of the wrench may include the partial recess 19 corresponding to one of the lugs 36 and a number of other recesses 18 equal to the number of lugs 36 minus one, to account for the lug corresponding to the partial recess 19. For example, the hammer union 30 shown in the drawings includes three (3) lugs 36 equally spaced around the perimeter of the collar 34. That is, the lugs 36 are spaced approximately 120° apart from each other about a longitudinal axis of the hammer union 30. Accordingly, the recesses 18 and the partial recess 19 are likewise spaced approximately 120° apart relative to the central axis of the head 14 such that each of the recesses 18 and the partial recess 19 aligns with one of the lugs 36.

In other embodiments, the total number of recesses 18 plus the one partial recess 19 may be less than the number of lugs 36 of the collar 34. In such embodiments, when the wrench 10 is positioned on the collar 34, any lugs 36 not corresponding to one of the recesses 18 or the partial recess 19 may occupy the empty space between the first end 20 and the second end 21 of the head 14.

With continued reference to FIG. 4, the wrench 10 may be rotated in the direction of arrow A, i.e., clockwise, to tighten the collar 34 on the pipe flanges 32. For tightening the collar 34, the wrench 10 is preferably positioned on the collar 34 such that the catch 22 is at a counterclockwise location relative to the handle 12. The handle 12 may then be rotated by a drilling operator in the clockwise direction of arrow A. The catch 22 engages a side of the lug 36 corresponding to the recess 18 nearest the first end 20 such that the catch 22 pulls the corresponding lug 36 in the direction of arrow A. Simultaneously, a portion of the second end 21 of the head 14 defining the partial recess 19 pushes a corresponding lug 36 in the direction of arrow A. The portions of the head 14 defining the other recesses 18 similarly engage corresponding lug 36 of the collar to assist in rotating the collar 34 in the direction of arrow A. In this manner, the collar 34 may be tightened on the pipe flanges 32 without the use of a sledgehammer.

Figure 5:
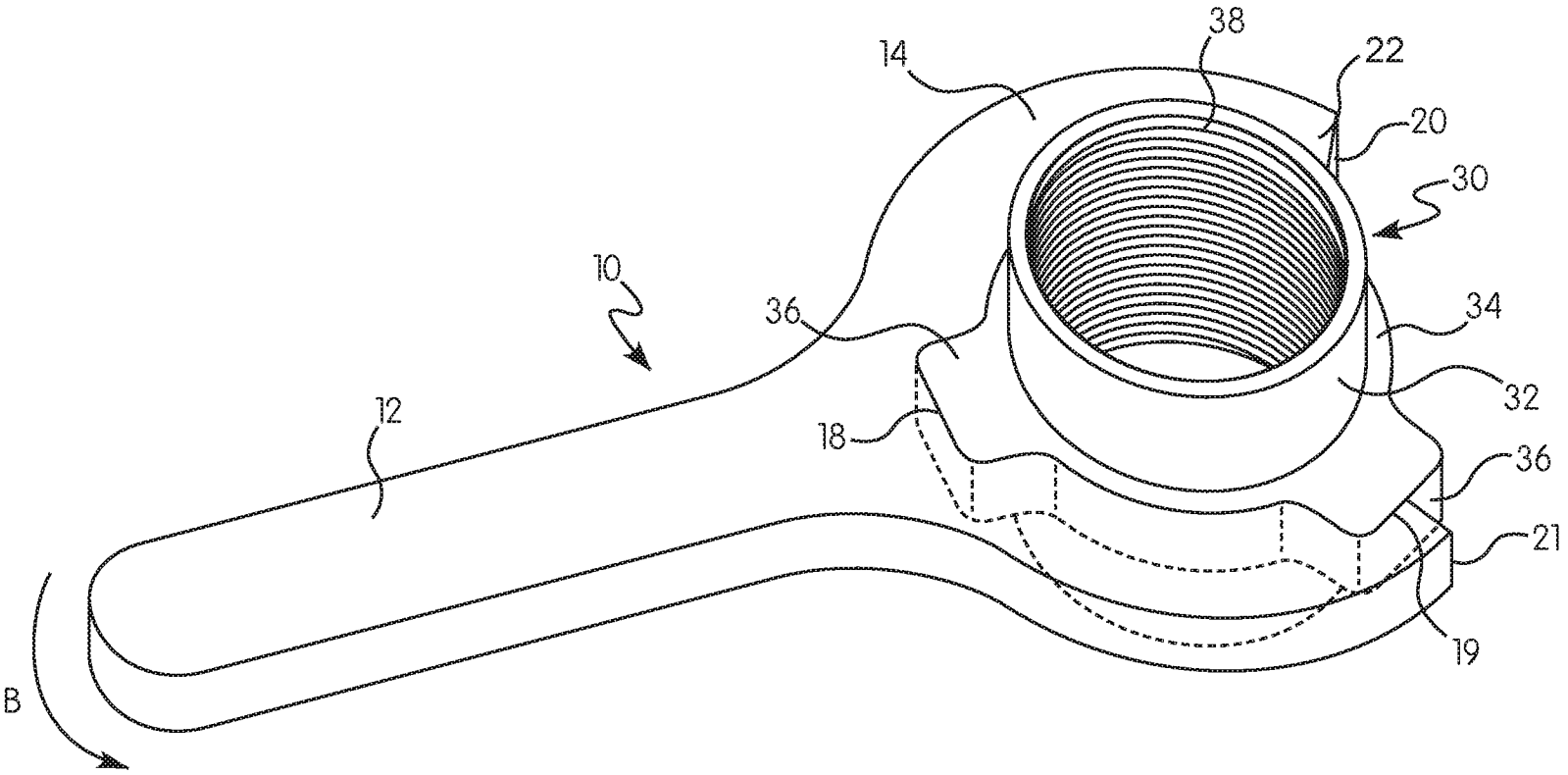
FIG. 5 is a perspective view of the wrench of FIG. 1 positioned on the hammer union of FIG. 3 in an unfastening orientation.

Referring now to FIG. 5, loosening or removal of the collar 34 from the pipe flanges 32 is substantially the opposite of the tightening the collar 34. The wrench 10 is preferably positioned on the collar 34 such that the catch 22 is at a clockwise location relative to the handle 12. The handle 12 of the wrench 10 is rotated by the drilling operator in the counterclockwise direction of arrow B to loosen the collar 34. The catch 22 engages a side of the lug 36 corresponding to the recess 18 nearest the first end 20 such that the catch 22 pulls the corresponding lug 36 in the direction of arrow B. Simultaneously, a portion of the second end 21 of the head 14 defining the partial recess 19 pushes a corresponding lug 36 in the direction of arrow B. The portions of the head 14 defining the other recesses 18 similarly engage corresponding lug 36 of the collar to assist in rotating the collar 34 in the direction of arrow B.

It is noted that the above descriptions of tightening and loosening of the collar 34 presumes a standard, right-handed threading of the collar 34. In the event that the hammer union 30 has a left-hand threaded collar 34, the positioning and rotating of the wrench 10 would simply be reversed. That is, the positioning of the wrench 10 shown in FIG. 4 and rotation of the wrench 10 in the clockwise direction of arrow A would correspond to loosening the collar 34, while the positioning of the wrench 10 shown in FIG. 5 and rotation of the wrench 10 in the counterclockwise direction of arrow B would correspond to tightening the collar 34.

The wrench 10 may be made in any size to accommodate various sizes of hammer unions 30. The wrench 10 may be constructed from a single piece of material or multiple pieces of material joined together. Suitable materials are generally rigid and may include tool steel or alloys having similar properties. Dimensional and material variations in the wrench 10 according to the present invention will be obvious to those skilled in the art and are to be considered as within the scope of the invention.

While several examples of a wrench are shown in the accompanying figures and described in detail hereinabove, other examples will be apparent to and readily made by those skilled in the art without departing from the scope and spirit of the present invention. For example, it is to be understood that aspects of the various embodiments described hereinabove may be combined with aspects of other embodiments while still falling within the scope of the present invention. Accordingly, the foregoing description is intended to be illustrative rather than restrictive. The devices of the present invention described hereinabove are defined by the appended claims, and all changes to the disclosed devices that fall within the meaning and range of equivalency of the claims are to be embraced within their scope.

What is claimed is:

1. A wrench, comprising:

a head having a first end and a second end; and a handle extending from the head;

wherein the head defines and at least partially surrounds an opening, wherein the head defines at least one recess continuous with the opening, wherein the head defines a partial recess at the second end of the head, wherein the total number of recesses and partial recesses is equal to a number of lugs of the hammer union, and wherein a distance between the first end and the second end of the head is greater than a cross-sectional diameter of a pipe flange of a hammer union.

2. The wrench of claim 1, wherein the partial recess has the same shape as at least a portion of the at least one recess.

3. The wrench of claim 1, wherein the first end of the head defines a catch configured to engage a lug of the hammer union.

4. The wrench of claim 1, wherein the at least one recess includes at least two recesses.

5. The wrench of claim 4, where the at least two recesses are spaced apart from one another about a central axis of the head of the wrench such that each of the recesses is configured to align with one lug of the hammer union.

6. The wrench of claim 4, wherein the at least two recesses are spaced approximately 120° apart from one another about a central axis of the head of the wrench.

7. The wrench of claim 1, wherein the partial recess is spaced apart from the at least one recess about a central axis of the head of the wrench such that the partial recess and each of the at least one recesses is configured to align with one lug of the hammer union.

8. The wrench of claim 1, wherein the handle is configured to be rotated by a drilling operator.

9. A method for fastening or unfastening a hammer union, the method comprising:

providing a hammer union having a first pipe flange, a second pipe flange, and a collar having one or more lugs, the collar configured to be threaded onto the first and second pipe flanges;

providing a wrench including a head and a handle extending from the head, wherein the head defines and at least partially surrounds an opening, and wherein the head defines at least one recess continuous with the opening, wherein the head of the wrench comprises a first end and a second end and wherein the head of the wrench defines a partial recess at the second end of the head, the partial recess configured to align with one of the lugs of the collar of the hammer union;

positioning the head of the wrench relative to the hammer union such that a central axis of the head of the wrench aligns with a longitudinal axis of the hammer union;

sliding the head of the wrench axially toward the collar of the hammer union such that each of the at least one recesses of the wrench aligns with one of the lugs of the collar of the hammer union; and rotating the handle of the wrench to rotate the collar of the hammer union relative to the first and second pipe flanges.

10. The method of claim 9, wherein a distance between the first end and the second end of the head is greater than a cross-sectional diameter of the first and second pipe flanges of a hammer union such that, during positioning of the head of the wrench relative to the hammer union, a portion of the first or second pipe flange is passed between the first and second ends of the head of the wrench.

11. The method of claim 9, wherein the first end of the head of the wrench defines a catch configured to engage one of the lugs of the hammer union.

12. The method of claim 11, wherein, if the wrench is used for fastening the collar of the hammer union, the wrench is positioned relative to the hammer union such that the catch is at a counterclockwise position relative to the handle.

13. The method of claim 11, wherein, if the wrench is used for unfastening the collar of the hammer union, the wrench is positioned relative to the hammer union such that the catch is at a clockwise position relative to the handle.

14. The method of claim 9, wherein the partial recess has the same shape as at least a portion of the at least one recess.

15. The method of claim 9, wherein the at least one recess defined by the head of the wrench includes at least two recesses.

16. The method of claim 15, wherein the at least two recesses are spaced approximately 120° apart from one another about the central axis of the head of the wrench.

17. The method of claim 9, wherein rotating the handle of the wrench is performed by a drilling operator.

* * * * *